US005329287A

United States Patent [19]

Strickland

[11] Patent Number: 5,329,287

[45] Date of Patent: Jul. 12, 1994

[54] END LOADED HELIX ANTENNA

[75] Inventor: Peter C. Strickland, Kanata, Canada

[73] Assignee: CAL Corporation, Ottawa, Canada

[21] Appl. No.: 893,525

[22] Filed: Jun. 4, 1992

[30] Foreign Application Priority Data

Feb. 24, 1992 [CA] Canada ..... 2061743-8

[51] Int. Cl.[5] ..... H01Q 11/08

[52] U.S. Cl. ..... 343/752; 343/895; 343/899

[58] Field of Search ..... 343/895, 752, 749, 899; H01Q 1/36, 11/08

[56] References Cited

U.S. PATENT DOCUMENTS

| | | | |
|---|---|---|---|
| 2,511,611 | 6/1950 | Wheeler | 343/895 |
| 3,573,840 | 4/1971 | Gouilbu et al. | 343/895 |
| 3,852,756 | 12/1974 | Reese | 343/895 |
| 3,858,220 | 12/1974 | Arnow | 343/802 |
| 4,012,744 | 3/1977 | Greiser | 343/895 |
| 4,014,028 | 3/1977 | Cone et al. | 343/895 |
| 4,051,481 | 9/1977 | Abreu | 343/895 |
| 4,121,218 | 10/1978 | Irwin et al. | 343/702 |
| 4,148,030 | 4/1979 | Foldes | 343/895 |
| 4,160,979 | 7/1979 | Drewett | 343/788 |
| 4,161,737 | 7/1979 | Albright | 343/749 |
| 4,163,981 | 8/1979 | Wilson | 343/752 |
| 4,169,267 | 9/1979 | Wong et al. | 343/895 |
| 4,309,707 | 1/1982 | James et al. | 343/895 |
| 4,494,117 | 1/1985 | Coleman | 343/895 |
| 4,580,023 | 4/1986 | Simpson | 219/10.55 |
| 4,772,895 | 9/1988 | Garay et al. | 343/895 |

FOREIGN PATENT DOCUMENTS

| | | | |
|---|---|---|---|
| 465508 | 5/1950 | Canada . | |
| 564984 | 10/1958 | Canada . | |
| 759565 | 5/1967 | Canada . | |
| 845308 | 6/1970 | Canada . | |
| 1186049 | 4/1985 | Canada . | |
| 1223346 | 6/1987 | Canada . | |
| 1257694 | 7/1989 | Canada . | |
| 128507 | 5/1991 | Japan | H01Q 11/08 |
| 1531925 | 11/1978 | United Kingdom . | |
| 2105521A | 3/1983 | United Kingdom . | |

OTHER PUBLICATIONS

Johnson et al, Antenna Engineering Handbook, Second Edition, 1984, Chapter 13.

*Primary Examiner*—Michael C. Wimer

*Attorney, Agent, or Firm*—Hayes, Soloway, Hennessey, Grossman & Hage

[57] ABSTRACT

A device is provided for use in a helical antenna having an antenna element wound about the periphery of a dielectric support post, the post being in the form of a tube or cylinder. The device has an electrically conductive member electrically connected to one end of said antenna element. The conductive member is of any appropriate shape or configuration and is operable to increase the loading on the antenna whereby standing waves on the antenna element are reduced and a more uniform electrical current is produced along the antenna element.

12 Claims, 5 Drawing Sheets

END LOADED HELIX ANTENNA

FIELD OF THE INVENTION

This invention relates to a helical antenna and in particular to a device for improving performance while reducing the size of conventional helical antennas.

BACKGROUND OF THE INVENTION

The increase in demand for mobile communication devices and in particular aeronautical satellite communication devices, which may be installed on light aircraft, has required that these devices become smaller. One of the larger components in these devices is the antenna. Antennas used for this type of communication are often large diameter helical antennas. The installation of these devices on light aircraft has thus created a need for smaller antennas and lower wind resistance. Further desirable qualities of a helix antenna for mobile communications devices would be reduced axial ratio, improved gain, wide bandwidth and reduced beamwidth.

Conventional helical antennas having the required gain, beam width and axial ratio performance would not fit into the space allotted within a radome of an aircraft or similar restricted space. It is also known to improve the gain of a helix antenna by tapering the helix pitch along the length of the antenna in the axial direction. This also provides reduced beam width.

SUMMARY OF THE INVENTION

The present invention seeks to provide a simple and economical method and apparatus which increases the gain, reduces the beam width, reduces the length and improves the axial ratio performance and the bandwidth of conventional helical antennas. In addition the device and method of the present invention may be used with all types of helix antennas including tapered diameter, tapered pitch, monofilar and multifilar type antennas.

In accordance with the present invention there is provided a device for use in a helical antenna having an antenna element wound about the periphery of a hollow dielectric support post, the post being in the form of a tube or cylinder and extending from a ground plane and generally normal to the ground plane, the improvement comprising:

an electrically conductive member electrically connected to one end of the antenna element; the conductive member being of any appropriate shape or configuration and operable to increase the loading on the antenna whereby standing waves on the antenna element are reduced and a more uniform electrical current is produced along the antenna element.

BRIEF DESCRIPTION OF THE DRAWINGS

These and other features of the invention will become more apparent from the following description in which reference is made to the appended drawings wherein.

DESCRIPTION OF PREFERRED EMBODIMENT

Figure 1:
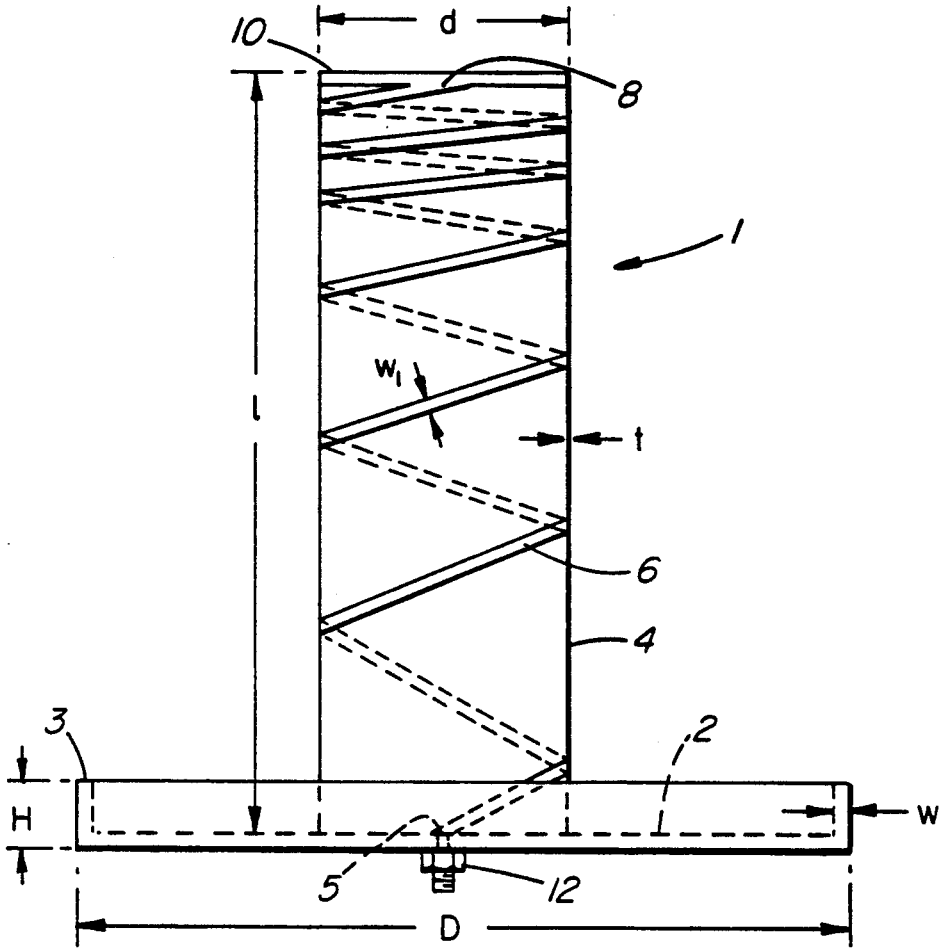
FIG. 1 shows the structure of a uniform diameter helical antenna having an end cap according to the present invention.

Referring to FIG. 1 a uniform diameter, axial mode helical antenna is shown generally by numeral 1. The antenna 1 has a circular ground plane 2 to which is attached a dielectric tube or cylinder 4. The dielectric tube 4 extends in a direction normal to the plane of the ground plane 2. The ground plane 2 in turn has an upwardly depending skirt 3 surrounding its perimeter. An antenna element or winding 6 is wound about the tube or cylinder 4. The winding 6 extends along the surface of the cylinder from its feedpoint 5 at the ground plane 2 to an end 8 remote thereof. The cylinder 4 has, at its end remote from the ground plane 2, a flat surface defining a plane parallel to the ground plane 2. A conductive cap 10 is attached to this surface at the remote end of the cylinder 4 and the free end 8 of the antenna element 6 is electrically connected by an ohmic contact to the conductive cap 10. The end of the antenna element 6 at the ground plane is connected to a suitable feed connector 12 which is isolated from the ground plane 2.

Figure 2:
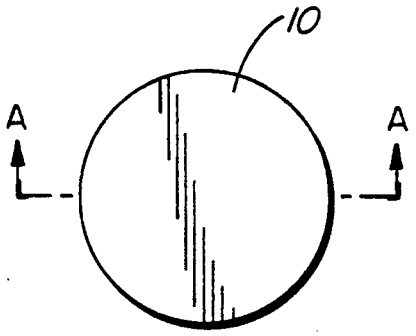
FIG. 2 is a top view of the end cap of FIG. 1.

Referring to FIG. 2, the top view of the cap is shown in which the cap 10 comprises a metallic or any suitable conductive material plate. The diameter of the plate cap 10 corresponds with the diameter of the dielectric cylinder 4. The thickness of the cap, on a prototype antenna, was 0.02 inches, however, it was found that the thickness has little impact on performance of the antenna.

The cap 10 and the ground plane 2 form a capacitor C, the capacitance of which may be expressed;

$$C = \frac{\epsilon A}{x} \tag{1}$$

Where $\epsilon$ is the permittivity x is the spacing between the cap 30 and the ground plane 2 and A is the cross-sectional area of the cap. This interaction between the cap 10 and the ground plane 2 results in current flow at the remote end 8 of the helix winding, thus suppressing standing waves which otherwise exist on the helix. This increases the bandwidth, since the structure is now more travelling wave in nature and less resonant. Since the current is now more uniform on the helix, the helix aperture is more uniformly illuminated thus resulting in narrower beamwidth and higher gain. Uniform current also improves the axial ratio.

Typical dimensions for the antenna described in the embodiments of FIGS. 1 and 2 are as follows:

| | |
|---|---|
| length of the cylinder 4: | l = 21.8 cm |
| diameter of the cylinder 4: | d = 5.5 cm |
| wall thickness of the cylinder 4: | t = 0.14 cm |
| width of the windings: | $w_1$ = 0.6 cm |
| diamter of ground plane: | D = 9.5 cm |
| thickness of ground plane: | w = 0.12 cm |
| height of ground plane skirt: | H = 2.73 cm |

The pitch of the winding is tapered from 18 mm at the feedpoint end to 10 mm at the remote end 8. It is also important that the feedpoint 11 of the windings and the free end 8 of the windings are aligned along a plane through the central axis of the cylinder 4. The width $w_1$ of the winding 6 may be varied, however, it is normally constant. The winding 6 may be bonded or etched on to the cylinder 4.

Figure 7:
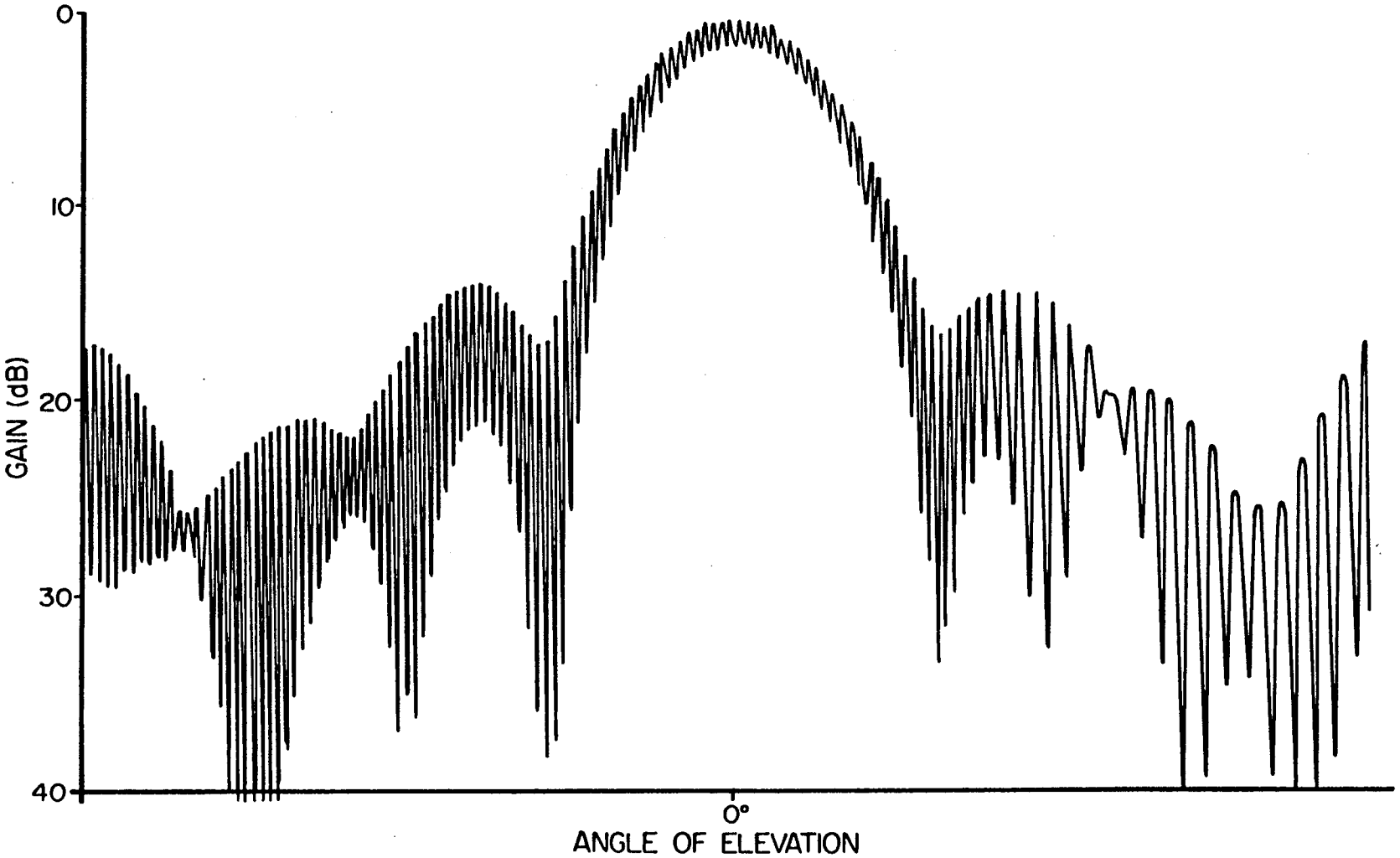
FIG. 7 is a plot of gain versus angle of elevation for an antenna according to the present invention.

The helical antenna as shown in FIGS. 1 and 2 has a performance indicated by the gain versus elevation plot of FIG. 7.

Figure 8:
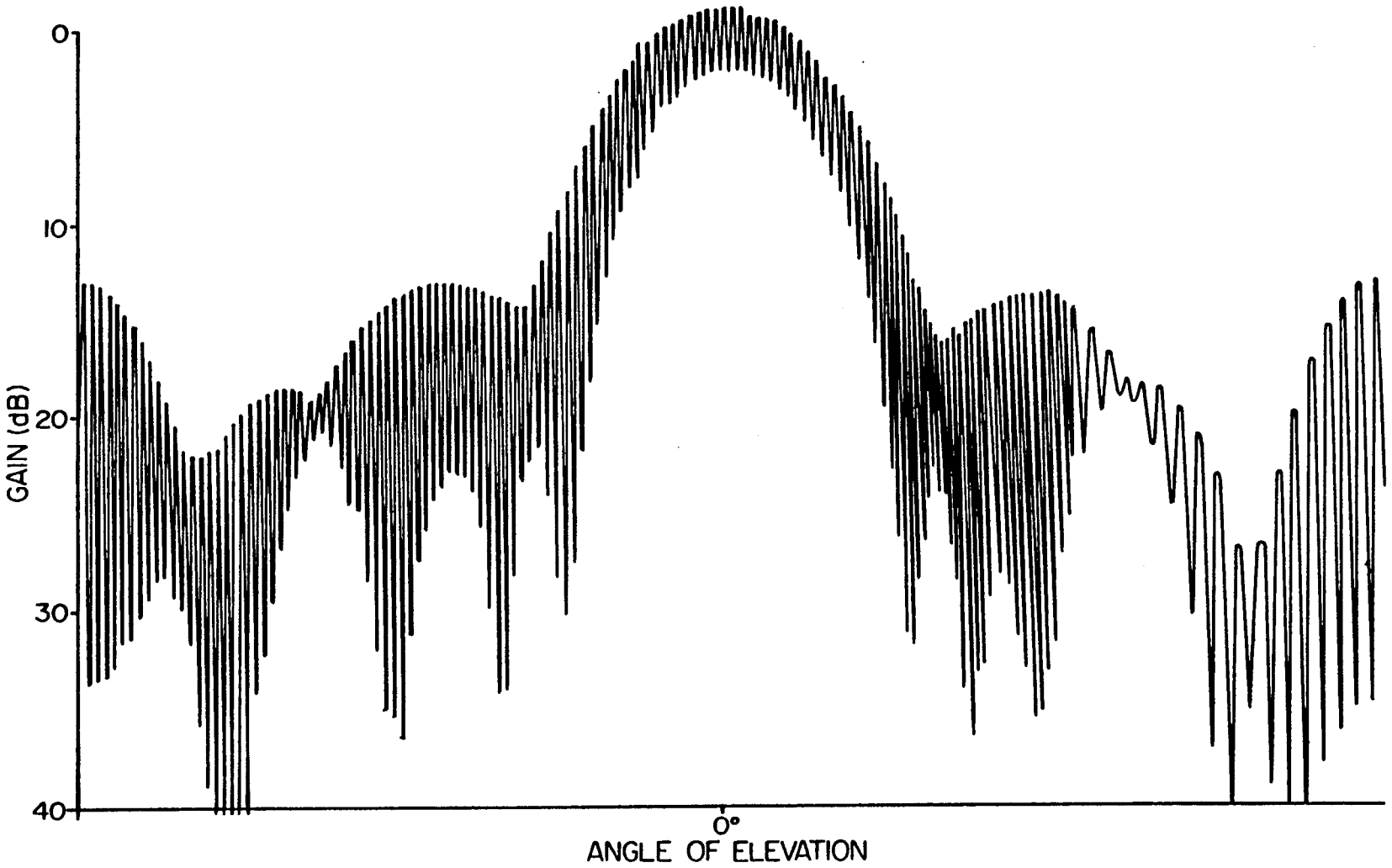
FIG. 8 PRIOR ART
FIG. 8 is a plot of gain versus angle of elevation for a prior art antenna.

By contrast the performance of a conventional uniform diameter helix antenna without a conductive disk may be seen from a gain versus elevation plot of FIG. 8.

Figure 3:
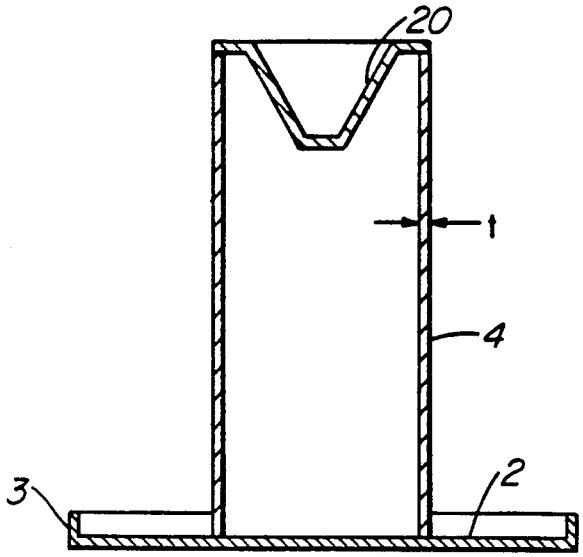
FIG. 3 is a sectional view of a further embodiment of an end cap according to the present invention.

Turning now to FIG. 3, a cross sectional view of an alternative embodiment of the conductive cap 10 is shown, along the line A—A of FIG. 2. The conductive cap 20 shown in FIG. 3 may be termed a sunken cap in that the cap 20 is concavely shaped with an inner central region projecting within the dielectric tube 4. The remote end 8 of the antenna element is electrically connected to the cap 20 as in the embodiment of FIG. 1.

Figure 4:
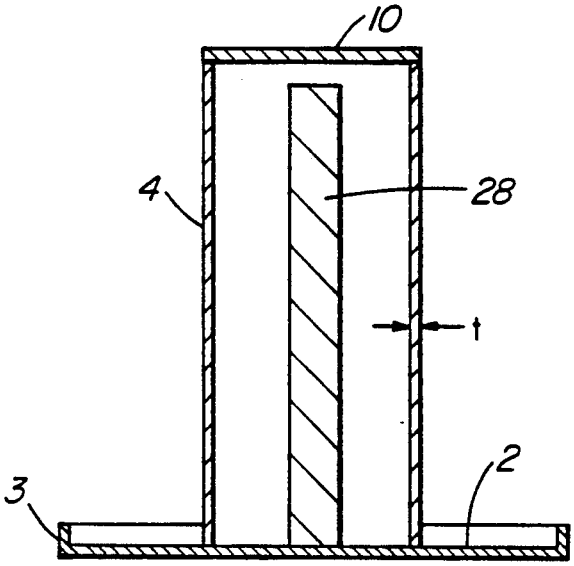
FIG. 4 is a sectional view of a further embodiment of the end cap according to the present invention.

FIG. 4 indicates a conductive post 28 which extends from the ground plane 2. The conductive post 28 is electrically connected at one end to the ground plane 2 and extends within the dielectric tube 4. The free end of the conductive post 28 is in proximity to the conductive cap 10 but is not in electrical contact with the cap 10. The conductive tube 28 may also be used in conjunction with the sunken cap 20 of FIG. 3.

Figure 5:
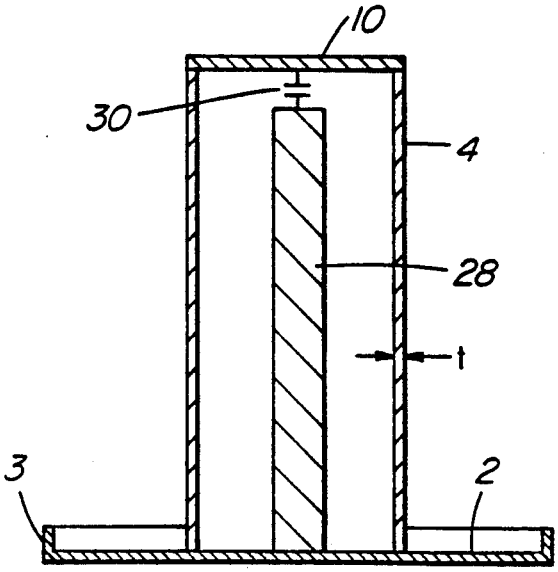
FIG. 5 shows a lumped capacitor in accordance with the present invention.

Referring to FIG. 5, the conductive post 28 as indicated in FIG. 4, is employed in addition to a lumped capacitor element 30 is connected from conductive cap 10 to the free end of conductive post 28.

Figure 6:
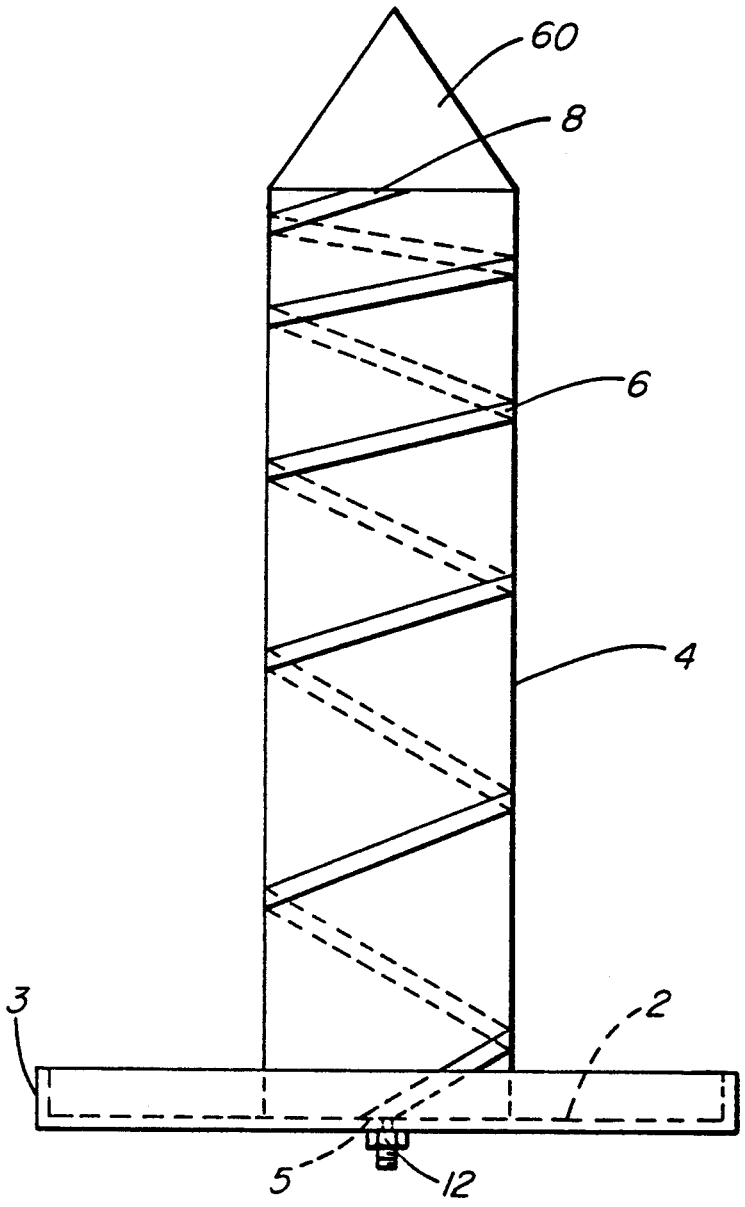
FIG. 6 shows a further embodiment of a uniform diameter decreasing pitch helical antenna.

Referring to FIG. 6, a uniform diameter helix antenna is indicated as in FIG. 1 however the pitch of the antenna element decreases as the antenna element progresses from the ground plane 2 to the end 8 remote from the ground plane 2. A cone shaped conductive cap 60 is shown in FIG. 6, to which the free end of the element 8 is ohmically connected.

It has been further found that the skirt 3 allows the diameter of the ground plane 2 to be reduced and it also increases the winding to ground plane capacitance while reducing backlobe and sidelobe energy.

While the invention has been described in connection with a specific embodiment thereof and in a specific use, various modifications thereof will occur to those skilled in the art without departing from the spirit and scope of the invention as set forth in the appended claims.

The terms and expressions which have been employed in the specification are used as terms of description and not of limitations, and there is no intention in the use of such terms and expressions to exclude any equivalents of the features shown and described or portions thereof, but it is recognized that various modifications are possible within the scope of the claims to the invention.

I claim:

1. In a helical antenna of the type having a ground plane; a hollow dielectric support tube with an end fixed to said ground plane and a free end, said support tube extending normal to said ground plane; and an antenna element with a feed end, a number of windings about the periphery of said support tube, and a free end arranged at said free end of said support tube, said antenna being for operation in the axial mode, the improvement comprising:

an electrically conductive member for placement over said free end of said support tube, said member being electrically connected to said free end of said antenna element; and said conductive member being a concavely shaped disc, with a central portion of said disc projecting into said dielectric support tube.

2. In a helical antenna of the type having a ground plane; a hollow dielectric support tube with an end fixed to said ground plane and a free end, said support tube extending normal to said ground plane; and an antenna element with a feed end, a number of windings about the periphery of said support tube, and a free end arranged at said free end of said support tube, said antenna being for operation in the axial mode, the improvement comprising:

an electrically conductive member for placement over said free end of said support tube, said member being electrically connected to said free end of said antenna element; and said conductive member being cone shaped with the apex of said cone projecting away from said ground plane.

3. In a helical antenna of the type having a ground plane; a hollow dielectric support tube with an end fixed to said ground plane and a free end, said support tube extending normal to said ground plane; and an antenna element with a feed end, a number of windings about the periphery of said support tube, and a free end arranged at said free end of said support tube, said antenna being for operation in the axial mode, the improvement comprising:

an electrically conductive member for placement over said free end of said support tube, said member being electrically connected to said free end of said antenna element; and including a conductive post electrically connected to said ground plane and extending substantially normal to said ground plane and within said hollow dielectric support tube, a free end of said conductive post being spaced from said conductive member.

4. A device as defined in claim 3, including a lumped reactive element electrically connected between said conductive member and said free end of said conductive post.

5. In a helical antenna of the type having a ground plane; a hollow dielectric support tube with an end fixed to said ground plane and a free end, said support tube extending normal to said ground plane; and an antenna element with a feed end, a number of windings about the periphery of said support tube, and a free end arranged at said free end of said support tube, said antenna being for operation in the axial mode, the improvement comprising:

an electrically conductive member for placement over said free end of said support tube, said member being electrically connected to said free end of said antenna element for increasing the loading on the antenna so that in use a current flows between said free end of the antenna element and said ground plane due to the capacitive coupling between said conductive member and said ground plane;

said conductive member being a concavely shaped disc, with a central portion of said disc projecting into said dielectric support tube.

6. In a helical antenna of the type having a ground plane; a hollow dielectric support tube with an end fixed to said ground plane and a free end, said support tube extending normal to said ground plane; and an antenna element with a feed end, a number of windings about the periphery of said support tube, and a free end arranged at said free end of said support tube, said antenna for operation in the axial mode, the improvement comprising:

an electrically conductive member for placement over said free end of said support tube, said member being electrically connected to said free end of said antenna element for increasing the loading on the antenna so that in use a current flow is produced between said free end of the antenna element and said ground plane due to the capacitive coupling between said conductive member and said ground plane;

said conductive member being cone shaped with the apex of said cone projecting away from said ground plane.

7. In a helical antenna of the type having a ground plane; a hollow dielectric support tube with an end fixed to said ground plane and a free end, said support tube being perpendicular on said ground plane; and an antenna element with a feed end, a number of windings about the periphery of said support tube, and a free end arranged at said free end of said support tube, said antenna for operation in the axial mode, the improvement comprising:

an electrically conductive member for placement over said free end of said support tube, said member being electrically connected to said free end of said antenna element for increasing the loading on the antenna so that in use a current flow is produced between said free end of the antenna element and said ground plane due to the capacitive coupling between said conductive member and said ground plane; and including a conductive post electrically connected to said ground plane and extending substantially normal to said ground plane and within said hollow dielectric support tube, a free end of said conductive post being spaced from said conductive member.

8. A device as defined in claim 7, including a lumped reactive element electrically connected between said conductive member and said free end of said conductive post.

9. In a helical antenna having an antenna element wound about the periphery of a hollow dielectric support tube extending from a ground plane in a direction generally normal to the ground plane, the improvement comprising:

an electrically conductive circular disc member electrically connected to one end of said antenna element, said one end of said antenna element being an end opposite a feed point end of said antenna element;

a conductive post electrically connected to said ground plane and extending substantially normal to said ground plane and within said hollow dielectric support tube, a free end of said conductive post being spaced from said conductive member;

said disc member being for increasing the loading on the antenna so that in use a current flows through the antenna element due to the capacitive coupling between said disc member and said ground plane, thereby reducing standing waves on said antenna element.

10. In a helical antenna of the type having a ground plane; a hollow dielectric support tube with an end fixed to said ground plane and a free end, said support tube extending normal to said ground plane; and an antenna element wound about the periphery of said support tube, said antenna being for operation in the axial mode, the improvement comprising:

an electrically conductive member for placement over said free end of said support tube, said member being electrically connected to one end of said antenna element, said one end of said antenna element being remote from a feed point of said antenna element; and said conductive member being a concavely shaped disc, with a central portion of said disc projecting into said dielectric support tube.

11. In a helical antenna of the type having a ground plane; a hollow dielectric support tube with an end fixed to said ground plane and a free end, said support tube extending normal to said ground plane; and an antenna element wound about the periphery of said support tube, said antenna being for operation in the axial mode, the improvement comprising:

an electrically conductive member for placement over said free end of said support tube, said member being electrically connected to one end of said antenna element, said one end of said antenna element being remote from a feed point of said antenna element; and said conductive member being cone shaped with the apex of said cone projecting away from said ground plane.

12. In a helical antenna of the type having a ground plane; a hollow dielectric support tube with an end fixed to said ground plane and a free end, said support tube extending normal to said ground plane; and an antenna element wound about the periphery of said support tube, said antenna being for operation in the axial mode, the improvement comprising:

an electrically conductive member for placement over said free end of said support tube, said member being electrically connected to one end of said antenna element, said one end of said antenna element being remote from a feed point of said antenna element; and including a conductive post electrically connected to said ground plane and extending substantially normal to said ground plane and within said hollow dielectric support tube, a free end of said conductive post being electrically isolated from said conductive member.

* * * * *